US005271763A

United States Patent [19]

Jang

[11] Patent Number: 5,271,763

[45] Date of Patent: Dec. 21, 1993

[54] ELECTRICAL DUST COLLECTOR

[75] Inventor: Jun-Ui Jang, Suwon, Rep. of Korea

[73] Assignee: Samsung Electronics Co., Ltd., Suwon, Rep. of Korea

[21] Appl. No.: 994,300

[22] Filed: Dec. 21, 1992

[30] Foreign Application Priority Data

Dec. 31, 1991 [KR] Rep. of Korea ..... 91-25774

[51] Int. Cl.[5] ..... B03C 3/41; B03C 3/47

[52] U.S. Cl. ..... 96/55; 96/62; 96/67; 96/77; 96/96; 96/98; 422/120

[58] Field of Search ..... 55/132, 6, 124, 138, 55/150, 151, 279, 521; 422/4, 5, 120

[56] References Cited

U.S. PATENT DOCUMENTS

| | | | |
|---|---|---|---|
| 2,864,460 | 12/1958 | Powers | 55/132 |
| 2,888,092 | 5/1959 | Powers | 55/132 |
| 3,537,238 | 11/1970 | Dungler | 55/131 |
| 3,999,964 | 12/1976 | Carr | 55/131 X |
| 4,229,187 | 10/1980 | Stockford et al. | 55/131 X |
| 4,323,374 | 4/1982 | Shinagawa et al. | 55/132 |
| 4,405,342 | 9/1983 | Bergman | 55/132 X |
| 4,715,870 | 12/1987 | Masuda et al. | 55/132 |
| 4,750,921 | 6/1988 | Sugita et al. | 55/132 |
| 4,940,470 | 7/1990 | Jaisinghani et al. | 55/131 X |

FOREIGN PATENT DOCUMENTS

| | | | |
|---|---|---|---|
| 46599 | 8/1971 | Japan | 55/131 |

*Primary Examiner*—Richard L. Chiesa

*Attorney, Agent, or Firm*—Burns, Doane, Swecker & Mathis

[57] ABSTRACT

A dust collector includes a front case and a rear case. A discharging electrode plate and an electrical charge plate are arranged zig-zag along guide elements formed in the front case, the guide elements extending in a front-to-rear direction. A dust collecting part is installed under the discharging electrode plate and the electrical charge electrode plate. An active carbon filter is installed in the rear case in order to deodorize the air.

11 Claims, 6 Drawing Sheets

ELECTRICAL DUST COLLECTOR

BACKGROUND OF THE INVENTION

1. Field of the Invention

The present invention relates to a electrical dust collector and more particularly to an arrangement of the discharging and charging electrodes of an electrical dust collector used in an air-conditioner or an air purifier.

2. Discription of the Prior Art

In an ordinary electrical dust collector used for an air conditioner or the air purifier, it is mounted in the front and it collects the charged dusts on the charging plate immediately after disturbing and charging the dust particles sucked into the air conditioner or air purifier.

The arrangements of a discharging electrode plate and of a charged plate functioning as dust collecting filter of the conventional electrically operated dust collector are disclosed in Shinagawa et al. U.S. Pat. No. 4,323,374. The patent is related only to the material of the charged plate or dust-collecting filter in order to increase the dust-collecting efficiency of the charged plate. Also, as an arrangement similar to U.S. Pat. No. 4,323,374, a conventional electrical dust collector is shown in FIGS. 1-3.

As shown in FIGS. 1 and 2, the conventional electrical dust collector 10 comprises a dust collecting guide 17 and electrical dust collectors 16 installed on both sides of the guide 17. The dust collecting guide 17 is provided with a negative electrode terminal 19, positive electrode terminal 20, a negative cable 18 connected to the negative electrode terminal 19, and a positive cable 21 the positive electrode terminal 20. And each of the electrical dust collecting parts 16 comprises an electrical charge plate 14 used as a dust collecting filter which is electrically connected to the negative cable 18, a discharging electrode plate 15 which is electrically connected to the positive electrode cable 21, and an active carbon filter 13. The active carbon filter 13 is in contact with the rear case 12 of an electrical dust collector 10 and absorbs the odor contained in the air. The electrical charge plate 14 and the discharging electrode 15 are provided between the active carbon filter 13 and the front case of the electrical dust collecting part 16. The dust particles directed as shown by arrows into the air-conditioner or the air purifier, are positively ionized and absorbed on the electrical charge plate 14 by the discharging electrode 15 when passing between the discharging electrode 15 and the electrical charge plate 14.

FIG. 3 shows the relationship of the discharging electrode 15 and the electrical charge plate 14 in FIG. 1 and FIG. 2.

As shown in FIG. 3, the discharging electrode 15 has the form of an upright zigzag, while the electrical charge plate 14 is arranged in a horizontal zigzag form without any contact with the charged electrodes 15.

A conventional electrical dust collector has such a constitution that a electrical charge plate 14 folded in a zigzag form has to be inserted between the discharging electrode 15, therefore it requires a considerable manpower in its manufacturing increases the product cost and may cause short-circuit between the discharging electrode 15 and the electrical charge plate 14.

SUMMARY OF THE INVENTION

Accordingly, it is an object of the present invention to provide an electrical dust collector which is easy to manufacture, lower in cost and avoids any danger of a short-circuit.

In order to achieve the above object, the present invention comprises a dust-collecting case including a front case section and a rear case section, plurality of protrusions arranged in rows at regular intervals in the inner upper and lower regions inside the front case, a discharge electrode plate extended and repeatedly arranged along upper outer protrusions and lower inner protrusions and connected the positive electrode of a voltage source for ionizing dust entrained in the air into a positive polarity, an electrical charge plate extended and arranged repeatedly along lower outer protrusions and upper inner protrusions and connected to ground and also arranged at a regular space facing the discharging electrode plate, a dust collecting part connected to a negative electrode of a voltage source for collecting the ionized dust in the air passing between the discharging electrode plate and the electrical charge plate and also positioned in contact with the rear edges of the discharging electrode plate and the electrical charge plate, and an active carbon filter installed on the rear case parallel to the dust collecting part for eliminating any odor contained in the air.

DESCRIPTION OF THE PREFERRED EMBODIMENT

Figure 1:
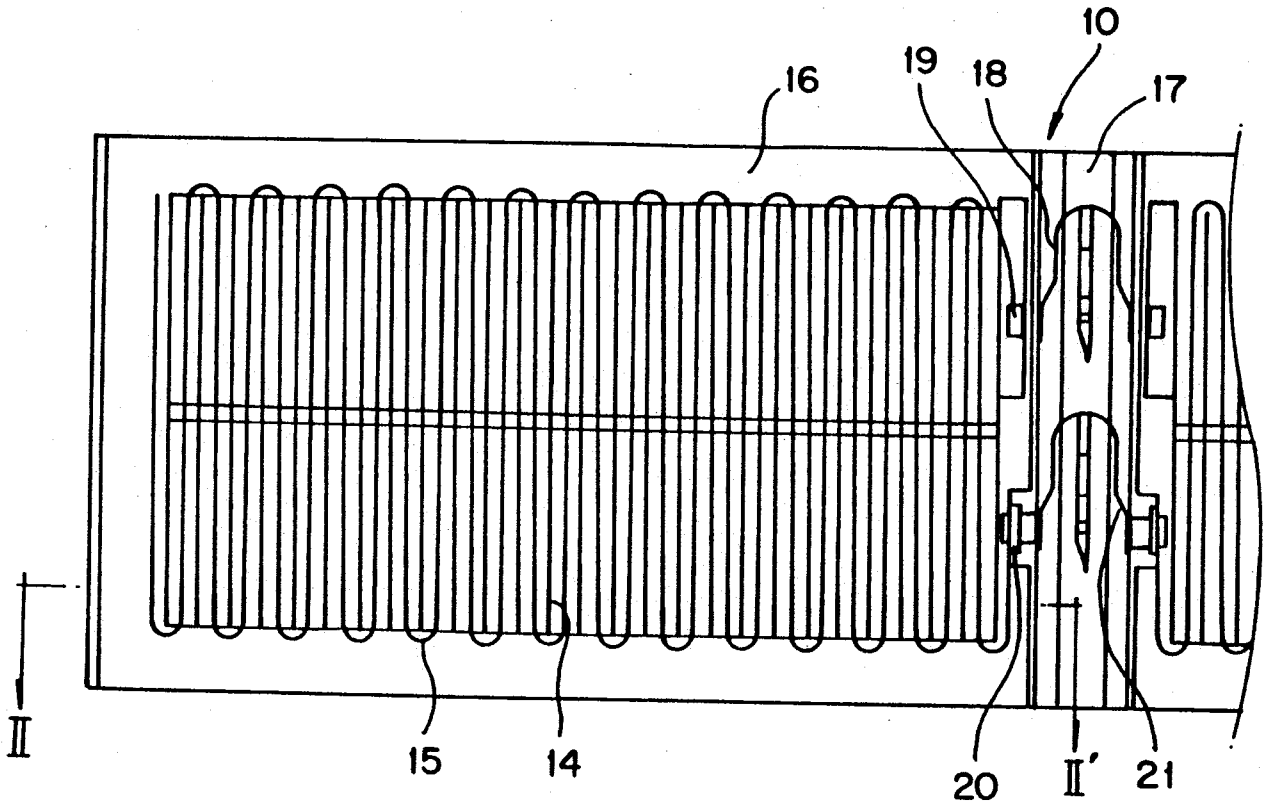
FIG. 1 (PRIOR ART)
FIG. 1 is a plan view of dust collector according to the prior art.
Figure 2:
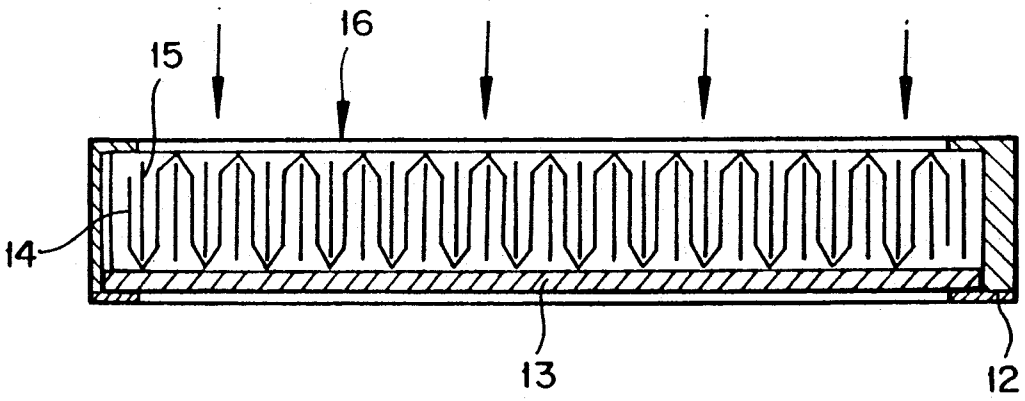
FIG. 2 (PRIOR ART)
FIG. 2 is a section taken along line II—II' of FIG. 1.
Figure 3:
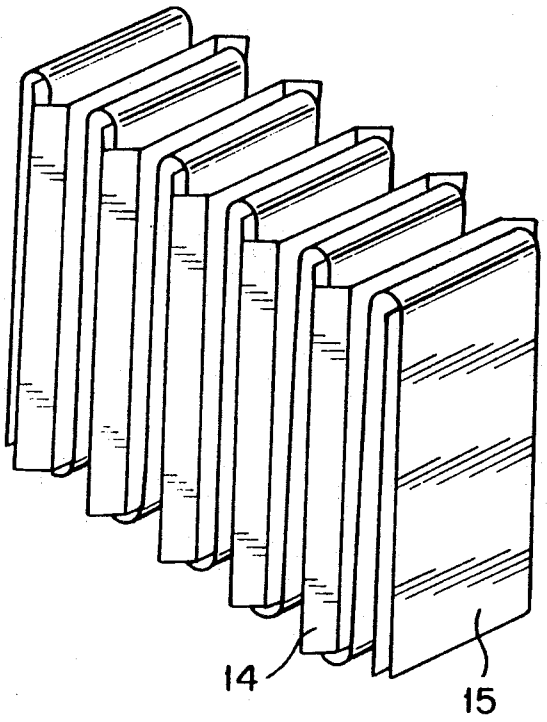
FIG. 3 (PRIOR ART)
FIG. 3 is a perspective view of the discharging electrode and the electrical charge plate of the prior art.
Figure 4:
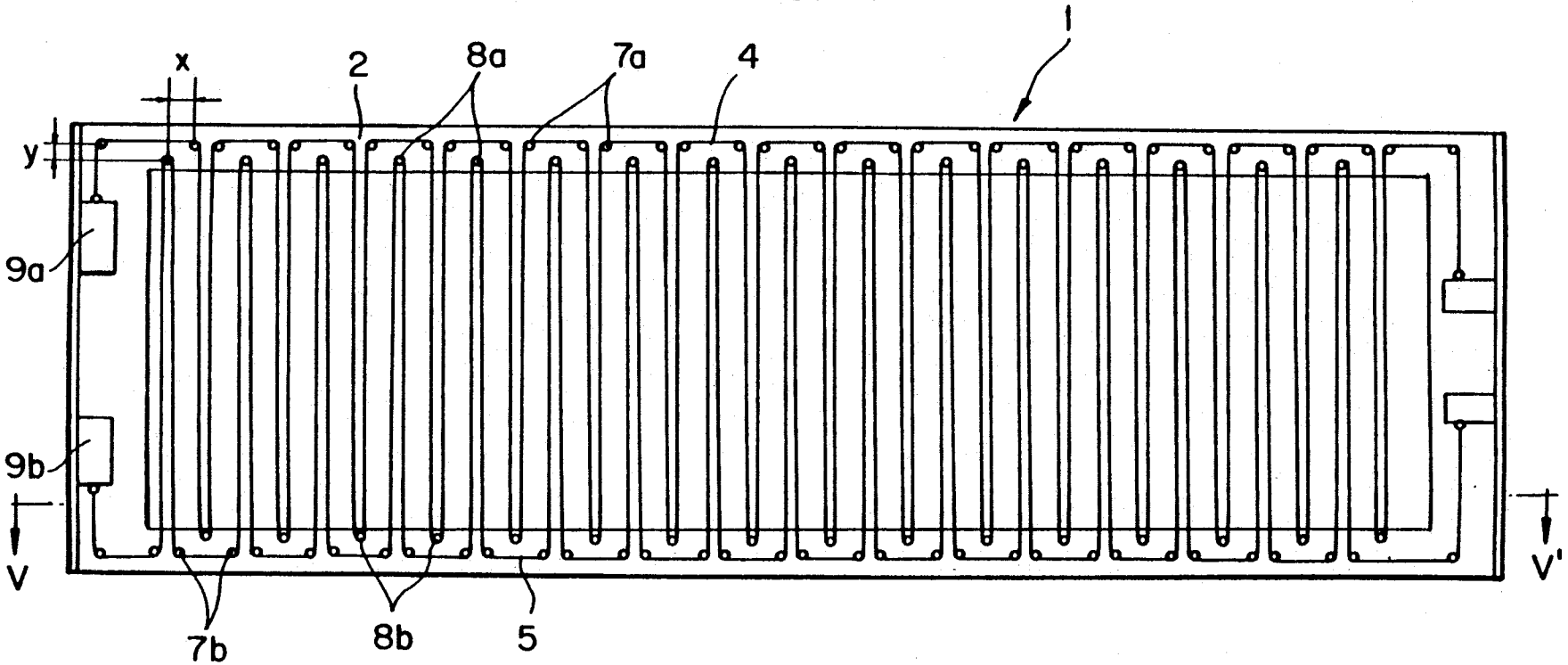
FIG. 4 is a front view of the electrical dust collector, according to this present invention.
Figure 5:
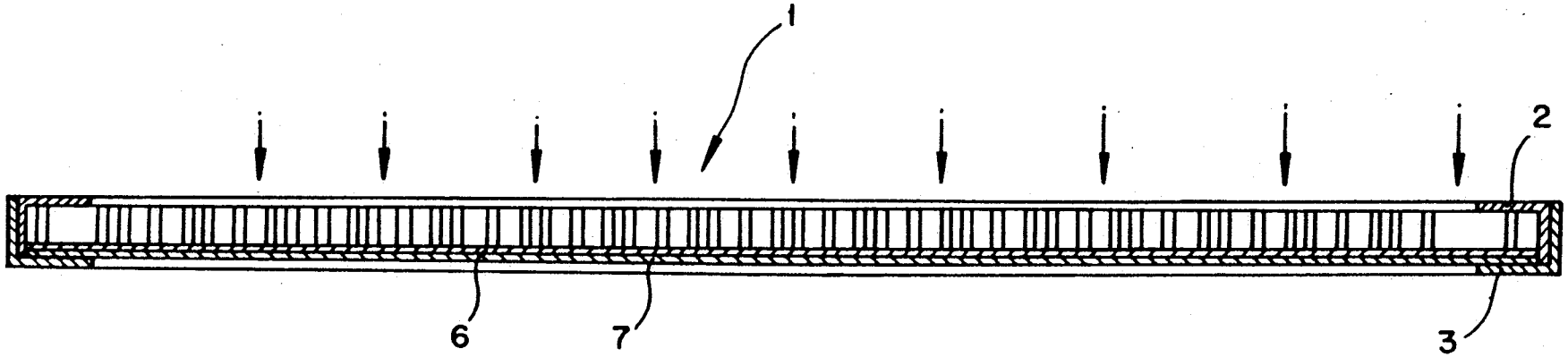
FIG. 5 is a section taken along line V—V' of FIG. 4.

As shown in FIGS. 4 and 5, the electrical dust collector 1 according to the invention comprises a front case 2 and a rear case 3. The front case 2 has a plurality of red-shaped guide elements or protrusions **7*a*, 7*b*, 8*a*, 8*b*** arranged at regular intervals in the upper and lower regions thereof as shown in FIG. 4.

It will be appreciated that the protrusions **7*a* and 7*b* form first and second outer rows of protrusions, respectively, and the protrusions 8*a* and 8*b* form first and second inner rows of protrusions, respectively. The inner rows of protrusions 8*a* and 8*b* are situated between the two outer rows of protrusions 7*a*, 7*b* and extend parallel thereto as can be seen in FIG. 4. Each of the inner rows of protrusions 8*a*, 8*b* is situated closer to a respective outer row of protrusions 7*a*, 7*b*** than to the other inner row.

A discharging electrode plate 4 connected to a high voltage positive electrode **9*a* is arranged by being wound on the upper outer protrusions 7*a* and the lower inner protruded rod 8*b*. An electrical charge plate 5 connected to the ground 9*b* is arranged by being wound on the lower outer protruded rods 7*b* and the upper inner protrusions 8*a***.

It is preferred that the upper and lower protrusions *7a, 7b, 8a, 8b* are arranged at equal intervals and also the lengthwise distance X between the outer protrusions *7a, 7b* and the inner protrusions *8a, 8b* is arranged to be shorter than the width wise distance Y, therebetween.

The discharging electrode plate 4 connected to a high voltage positive electrode *9a* is bent around two upper protruded rods *7a,* and is bent around a lower inner protrusion *8b* and then extends toward the next upper outer protrusions *7a,* repeatedly.

Meanwhile, the electrode charge plate 5 connected to the ground *9b* is bent around two lower outside protrusions *7b* and is bent around an upper protrusion *8a* and then extends toward the next lower outer protrusion *7b,* repeatedly.

By this arrangement, there is no contact between the discharging electrode plate 4 and the electrical charged plate 5 and at the same time a certain special interval therebetween can be maintained.

The dust entrained in the air is positively ionized by the discharging electrode plate 4 connected to the positive electrode at the time of passing between the discharging electrode plate 4 and the electrical charge plate 5. A dust collecting part 6 reversely polarized from the discharging electrode plate 4 is installed closely to the rear edges of the discharging electrode plate 4 and the electrical charge plate 5. That is to say, the dust collecting part 6 has a negative polarity and a flat plate form.

An active carbon filter 7 used for eliminating any odor contained in the air is arranged in back of the dust collecting part 6 and installed on the rear case 3 in parallel to the dust collecting part 6.

Accordingly, any dust and odor contained in the air are sucked into the electrical dust collector 1. The dust is ionized to a positive polarity by the discharging electrode plate 4 having a high-voltage (3–4 Kv) positive polarity and then collected on the dust collecting part 6 having a negative polarity, where as the odor is eliminated by the activated carbon filter 7. Finally, only fresh air is discharged into the room.

Figure 6:
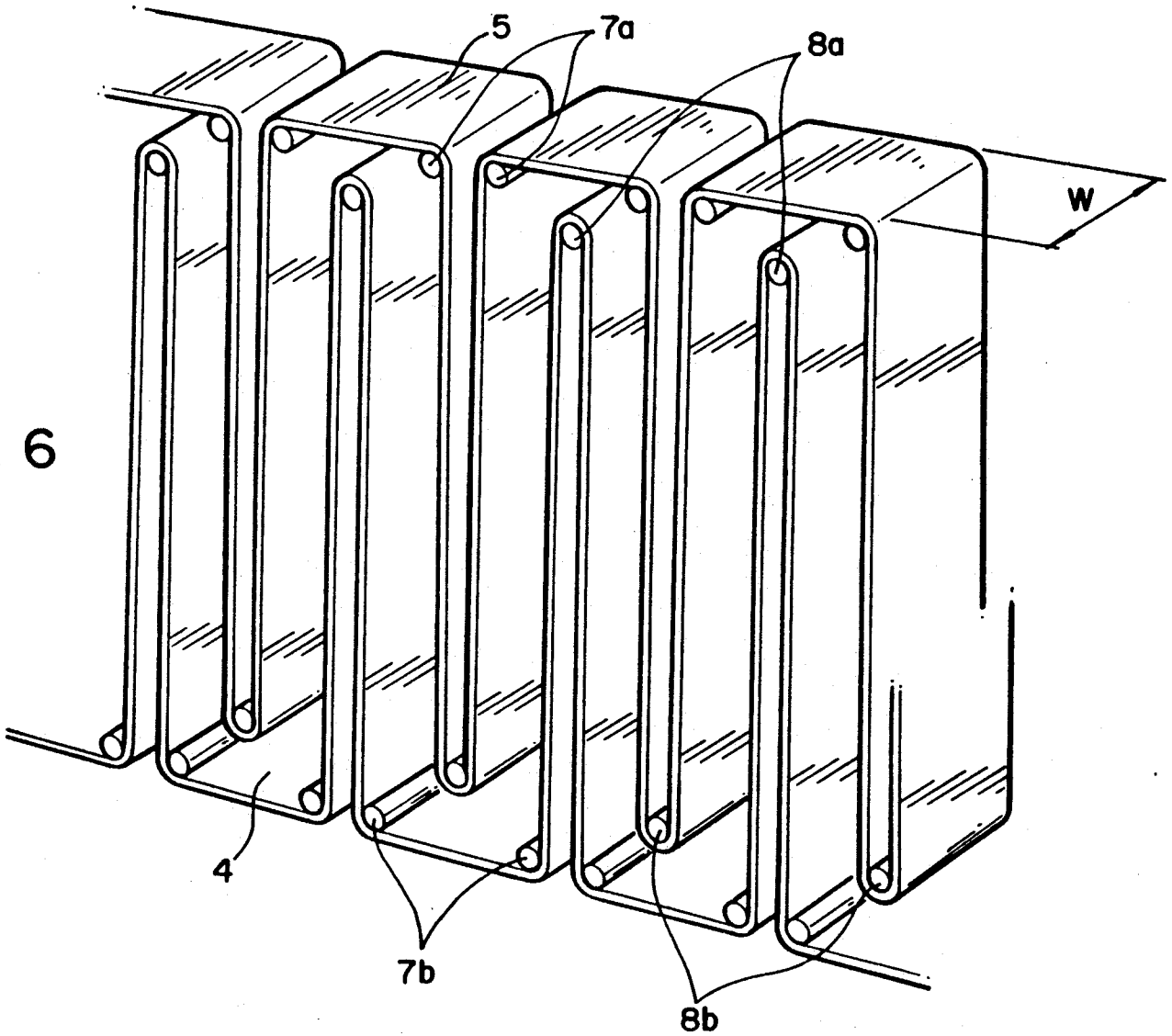
FIG. 6 is a perspective view of the discharging electrode plate and the electrical charge plate according to the present invention.

Referring to FIG. 6 in a preferred embodiment of the present invention, the protruded rods *7a, 7b, 8a, 8b* extend the entire width W of the front case 2 from the front case 2 or are slightly shorter.

The discharging electrode plate 4 and the electrical charge plate 5 are arranged along the protruded rods *7a, 7b, 8a, 8b* to not contact each other and maintain a certain arrangement.

The electrical charge plate 5 of the present invention can define dust collecting plate as in the case of the prior art.

In that case, the electrical charge plate 5 is connected to the negative electrode of a high voltage source, hence the dust collecting section 6 can be omitted.

Because the electrical dust collector according to the invention has a plurality of protruder rods arranged in the front case and also the discharging electrode plate and the charge plate are arranged facing each other, they do not contact each other and therefore there is no danger of a short-circuit. Also, the collector is easy to manufacture, lower in manufacturing cost, easy to install since the dust collecting part is a plate form, and the dust collecting efficiency is increased since the dust collecting section can be installed separately on the rear case.

What is claimed is:

1. An electrical dust collector for collecting dust entrained in an air flow, comprising:

a casing defining a front air inlet and a rear air outlet for the airflow;

a plurality of guide elements disposed in said casing and forming;

first and second outer rows of guide elements, and first and second inner rows of guide elements situated between said first and second outer rows;

a discharging electrode plate wound in zig-zag fashion around guide elements of said first outer row and said second inner row and being positively charged for ionizing the entrained dust to a positive polarity; and a dust collecting electrode plate arranged in a zig-zag fashion around guide elements of said second outer row and said first inner row in spaced relationship to said discharge electrode plate, said dust collecting electrode plate being connected to a negative electrode for collecting dust ionized by said discharging electrode plate.

2. Apparatus according to claim 1, wherein said first and second outer rows are parallel to each other and to said first and second inner rows.

3. Apparatus according to claim 1, wherein said guide elements of each of said outer rows are spaced apart by a distance shorter than a distance separating said outer rows, said guide elements of each of said inner rows being spaced apart by a distance shorter than a distance separating said inner rows.

4. Apparatus according to claim 1, wherein each of said inner rows are disposed closer to a respective outer row than to each other.

5. Apparatus according to claim 1 including an active carbon filter positioned across said air outlet for deodorizing the air passing therethrough.

6. Apparatus according to claim 5, wherein said filter is in contact with edges of said discharging electrode plate and said dust collecting electrode plate.

7. Apparatus according to claim 1, wherein said casing includes front and rear case sections forming said air inlet and outlet, respectively, said guide elements projecting from said front case section.

8. An electrical dust collector for collecting dust entrained in an air flow, comprising:

a case defining a front air inlet and a rear air outlet for the air flow;

a plurality of guide elements extending front-to-rear in said casing and forming:

first and second outer rows of guide elements, and first and second inner rows of guide elements situated between said first and second outer rows;

a discharging electrode plate wound in zig-zag fashion around guide elements of said first outer row and said second inner row and being positively charged for ionizing the entrained dust to a positive polarity;

an electrical charge plate wound in zig-zag fashion around guide elements of said second outer row and said first inner row in spaced relationship to said discharging electrode plate, said electrical charge plate being connected to ground; and a dust collection member disposed between said air outlet on one side and said discharging electrode plate and electrical charge plate on the other side, said dust collecting member being connected to a negative electrode for collecting ionized dust which has passed between said discharge electrode plate and said electrical charge plate, said dust collecting member being in contact with edges of said discharging electrode plate and said electrical charge plate.

9. Apparatus according to claim 8 including an active carbon filter disposed between said air outlet and said dust collecting member and extending parallel to the latter for deodorizing the air.

10. Apparatus according to claim 8, wherein said case comprises front and rear case sections forming said air inlet and air outlet, respectively, said guide elements projecting from said front case section.

11. Apparatus according to claim 8, wherein said guide elements of each of said outer rows are spaced apart by a distance shorter than a distance separating said outer rows, said guide elements of each of said inner rows being spaced apart by a distance shorter than a distance separating said inner rows.

* * * * *